United States Patent [19]

Ostrowsky

[11] 4,402,418

[45] Sep. 6, 1983

[54] TAMPERPROOF CLOSURE

[75] Inventor: Efrem M. Ostrowsky, Highland Park, Ill.

[73] Assignee: Ethyl Products Company, Richmond, Va.

[21] Appl. No.: 325,490

[22] Filed: Nov. 27, 1981

[51] Int. Cl.[3] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,153,174 | 5/1979 | Keeler | 215/252 |
| 4,196,818 | 4/1980 | Brownbill | 215/252 |
| 4,206,851 | 6/1980 | Ostrowsky | 215/252 |
| 4,322,012 | 3/1982 | Conti | 215/252 |

FOREIGN PATENT DOCUMENTS

| | | | |
|---|---|---|---|
| 1213931 | 11/1959 | France | 215/252 |
| 47912 | 12/1979 | France | 215/252 |

*Primary Examiner*—Donald F. Norton

*Attorney, Agent, or Firm*—Donald L. Johnson; John F. Sieberth; Edgar E. Spielman

[57] ABSTRACT

This invention relates to a tamperproof package which includes a thermoplastic closure for fitment to a container which has a threaded neck portion and an outwardly extending annular flange adjacent but beneath the threaded neck portion. The thermoplastic closure features an annular band which is attached to the lowermost extent of the closure sidewall by way of a plurality of spaced-apart frangible ribs. Pendantly attached to the lower portion of the annular band is a plurality of spaced-apart tabs. These tabs are inwardly foldable so that a tab portion will be in a position of interference with the container annular flange when the closure is fitted to the container. This interference prevents removal of the closure from the container unless there is fracture of the frangible ribs. Rib fracture indicates that the closure has been tampered with by removal or attempted removal of the closure.

13 Claims, 4 Drawing Figures

TAMPERPROOF CLOSURE

BACKGROUND OF THE INVENTION

The utilization of tamperproof container-closure packages, in which the closure is of a thermoplastic material, is receiving wide acceptability in the market place. Such packages will become even more market dominant upon acceptance by the carbonated beverage industry of the use of thermoplastic closures. One such closure is shown in U.S. Pat. No. 4,206,851. This type of closure has an annular tamperproof band disposed downwardly from the bottommost extent of the closure sidewall. The band has at least one frangible area. Attachment to the closure sidewall by the band is achieved by the utilization of a plurality of spaced-apart non-frangible ribs. The container to which this type of closure is to be fitted has an annular flange beneath the thread portion of the container neck. With the closure fitted to the container, the position of the tamperproof band is such that it is disposed, for the most part, at a position lower than the container annular flange. With the closure so fitted, heat is then applied to the closure band so that it shrinks to a position of interference underneath the container flange. Removal of the closure from the container is by unthreading which results in upward axial movement of the closure. Since the tamperproof band is in an interfering fit with the annular container flange, its axial movement is prevented unless rupture of the band occurs. By providing the frangible areas in the band, such rupturing does occur and is the visible indication that the package has been tampered with.

Another type of tamperproof system which uses thermoplastic closures is the one in which there is provided a tamperproof band which is attached to the lowermost extent of the closure sidewall by a plurality of frangible ribs. The band itself has no frangible areas. The closure and the container will both have configurations which coact together to lock the band to the container when the closure is rotated to achieve its removal from the container. For example, one particularly popular system utilizes a container having a set of projections which coact with an annular array of teeth which are found on the tamperproof band. The teeth and projections do not coact with one another when the closure is applied to the container, however, when the closure is torqued for removal, the teeth and projections coact in an interfering manner which prevents the entire closure from rotating. Raising the removal torque in the closure results in fracturing of the ribs and thus separation of the band from the remainder of the closure. The closure can now be rotated to achieve removal. This separation of the band from the closure gives visual indication to the consumer that tampering has occurred.

While the two before-described systems are viable, each has a drawback. The first-described system, which utilizes a heat shrinking technique to obtain interference between the tamperproof band and the annular container flange, is disadvantaged in the heat shrinking technique is relatively expensive equipment wise and cycle time wise. The other described tamperproof system is disadvantageous in that the tamperproof band, after it has been separated from the remainder of the closure, is free to fall from the container neck. As can be appreciated, this characteristic can result in a nuisance for the consumer as attempts to pour the contents from the container will also tend to deposit the separated tamperproof band into the same receptacle in which the container contents are being poured.

Therefore, it is an object of this invention to provide a high fidelity tamperproof system for use with thermoplastic closures which is inexpensive for the packager and which makes possible the permanent capture of the tamperproof band to the container.

THE INVENTION

This invention relates to a tamperproof package which includes a thermoplastic closure for fitment to a container which has a threaded neck portion and an outwardly extending annular flange adjacent to but beneath the threaded neck portion. The thermoplastic closure has a top wall and an annular sidewall downwardly extending from the top wall. About the inside surface of the closure sidewall, there is a thread for cooperation with the container neck thread. The closure additionally features an annular band attached to the lower portion of the annular sidewall and having an inside diameter larger than the diameter of the container annular flange. Attachment of the annular band to the annular sidewall is effected by a plurality of spaced-apart frangible ribs which are attached at their upper ends to the closure sidewall and are attached at their lower ends to the annular band. Pendantly attached to the lower portion of the annular band is a plurality of spaced-apart tabs. The tabs are inwardly foldable so that a tab portion will be in a position of interference with the container annular flange when the closure is fitted to the container. This interference between the tab portion and the annular flange resists axial upward movement of the closure upon the application of unthreading torque to the closure. As the torque increases the frangible ribs are broken thereby allowing the closure, minus the annular band and spaced-apart tabs, to be removed from the container. The annular band with the tabs are captured to the container as the interference between the tab portions and the annular container flange still exists.

In a preferred form, the tab portions achieve their position of interference by being in abutment or in near abutment with the underside of the container annular flange. A particularly preferred configuration is one in which the tab portion is triangular in shape, with the base of the triangle lying in a plane substantially perpendicular to the center axis of the closure when the tab is inwardly folded. With the triangular configuration, the tab portion will operate in the same manner as a barb, i.e. offer little resistance to the fitment of the closure to the container but resist removal of the closure from the container.

These and other features of this invention contributing to satisfaction in use and economy in manufacture are to be more fully understood from the following descriptions and drawings of the embodiment of this invention in which identical numerals refer to identical parts and in which.

Figure 1:
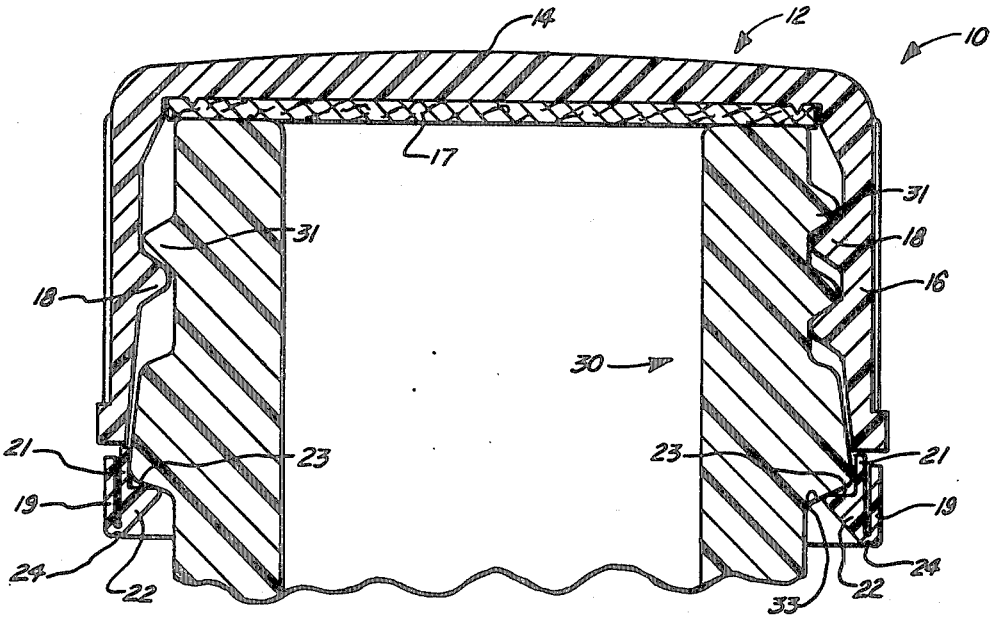
FIG. 1 is a sectional view taken through a closure of this invention fitted to a container neck finish.

Referring now to FIG. 1, there can be seen a tamperproof package of this invention, generally designated by the numeral 10, which comprises a thermoplastic closure, generally designated by the numeral 12, and a container having a threaded neck finish, generally designated by the numeral 30. Closure 12 has a circular top wall and an annular sidewall downwardly depending therefrom. About the inside surface of annular sidewall 16 is closure thread 18. Nested against the inside surface of top wall 14 is liner 17 which is utilized to obtain a liquid-tight seal between closure 12 and container neck finish 30. It should be understood, however, that linerless sealing systems are also suitable for use with the tamperproof system of this invention.

Figure 2:
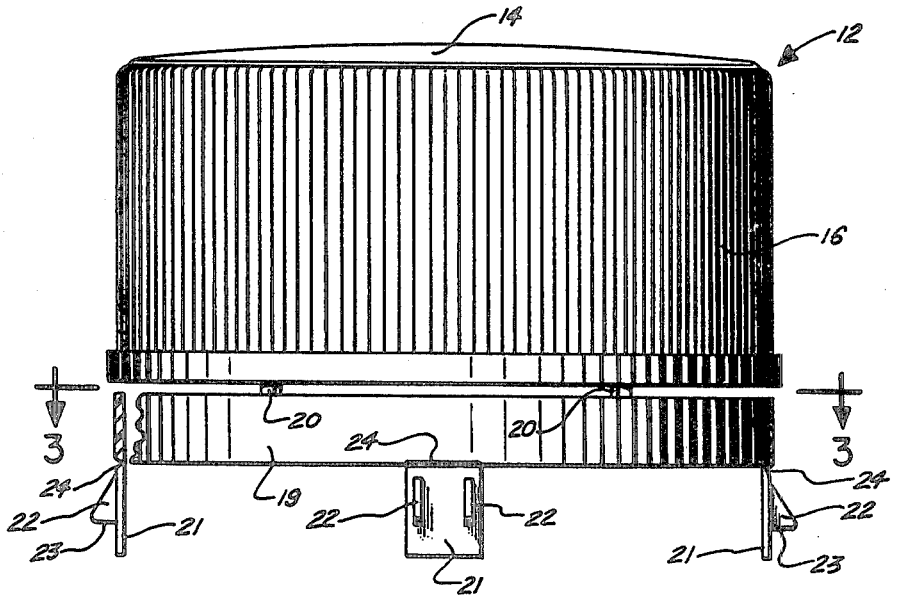
FIG. 2 is a side elevational view, partially broken away, of the closure shown in FIG. 1 prior to its fitment to the neck finish.
Figure 3:
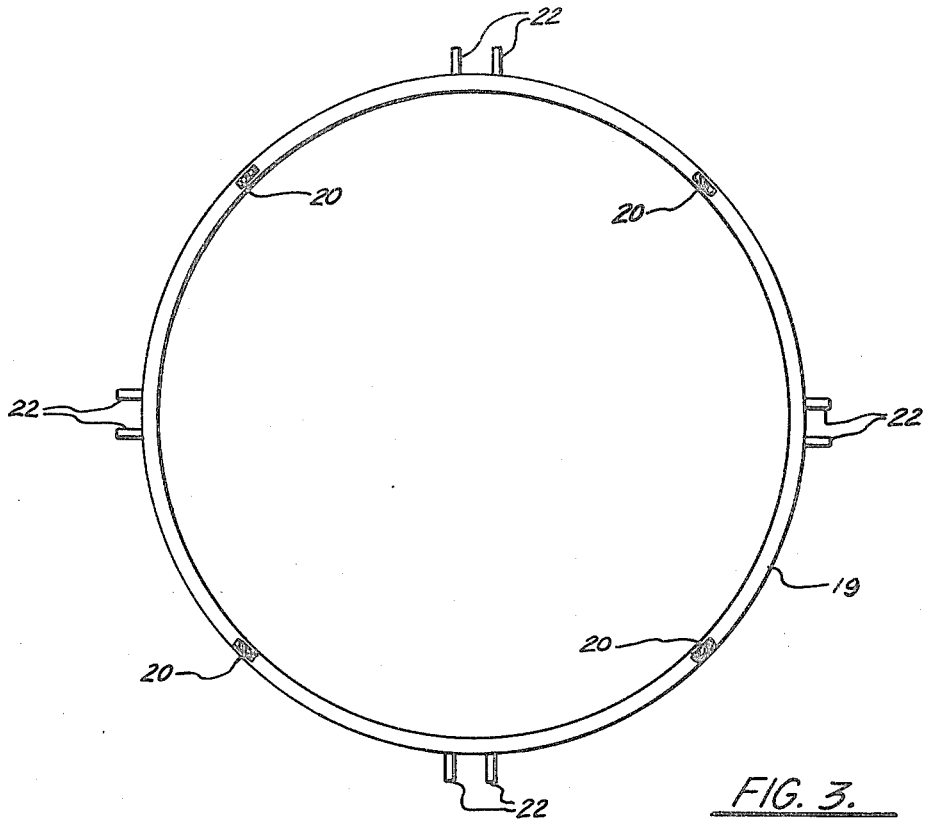
FIG. 3 is a sectional view taken through section lines 3—3.

Attached to the lowermost extent of annular sidewall 16 is annular band 19. As is seen in FIGS. 2 and 3, annular band 19 is attached to annular sidewall 16 by way of a plurality of spaced-apart frangible ribs 20. Frangible ribs 20 are dimensioned so that they will be frangible under the influence of that amount of upward axial force which results from the application of removal torque applied to closure 12 to effect its removal from the container. Generally speaking, fracturing should occur upon the application of from about 5 inch pounds to about 18 inch pounds of torque which amount of torque is normally acceptable to the consumer. The dimensions of ribs 20 will also be dependent upon the material of construction of the closure. The stronger the material of construction the smaller will be the dimensions of ribs 20 and vice versa.

Annular band 19 has pendantly attached thereto a plurality of spaced-apart tabs 21. For the embodiment shown in the drawings, tabs 21 are located equiangularly around band 19. As can be seen in FIG. 3, four tabs are provided, however, it should be understood that more tabs may be utilized as the need arises. In fact, while four tabs are shown for the embodiment shown in drawings, it should be understood that a less number may be utilized, e.g. two oppositely opposed tabs may be used in some instances. When closure 12 is initially molded, tabs 21 are downwardly disposed from annular band 19. This configuration is shown in FIG. 2. To provide a tab portion which will attain a position of interference with container annular flange 32, as hereinafter described, the illustrated embodiment provides for projections 22 which are integrally formed to tabs 21. As initially molded, projections 22 will extend outwardly. See FIG. 2. Upon inward folding of tabs 21, projections 22 will extend inwardly of closure 12 as is seen in FIG. 1. For the illustrated embodiment, projections 22 have a configuration which is triangular in shape, with the base 23 of the triangle being initially in a position facing away from the top of closure 12.

It is preferred that tabs 21 be pendantly attached to band 19 by way of individual hinges 24 which are of reduced thickness to facilitate inward folding of the tabs. Since each hinge follows the curved portion of band 19 to which it is attached, there is a tendency of tabs 21 to follow the hinge curvature. Thus, when a tab is moved from its initial position, shown in FIG. 2, to its final position, shown in FIG. 3, it experiences curvature reverse. This reverse is resisted by the tab and is used to aid in maintaining the tab in its final position. This phenomenon is beneficial as it keeps the tabs in the desired folded position.

Fitment of closure 12 to neck finish 30 is preceded by folding of tabs 21 to the position shown in FIG. 1. This is conveniently done by the utilization of a two-stage punch procedure. The first stage will start tabs 21 in the direction of their inward folded position with the second stage continuing the inward folding until the fold-back position is realized. As can be seen in FIG. 1, when tabs 21 are in their final folded position, base 23 of triangular projections 22 will be facing upwardly towards the top wall of closure 12. Also note that the inside surface of each tab will be adjacent or in abutment with the inside surface of band 19.

With the tabs in their folded position, closure 12 can then be simply threaded onto the container neck finish 30. Since the hypotenuse of the triangular configuration of projections 22 is facing downwardly, projections 22 will simply ride over container thread 31. Projections 22 will also ride over container annular flange 32. There will, of course be some outward flexing of annular band 19 but such flexing will not be so severe as to cause premature fracture of frangible ribs 20. Once closure 12 has been fully threaded onto neck finish 30, projections 22 will be positioned so that base 23 underlies at least a portion of the underside 33 of container flange 32. With base 23 underlying underside 33, there is presented a surface of interference—by base 23—to underside 33.

Figure 4:
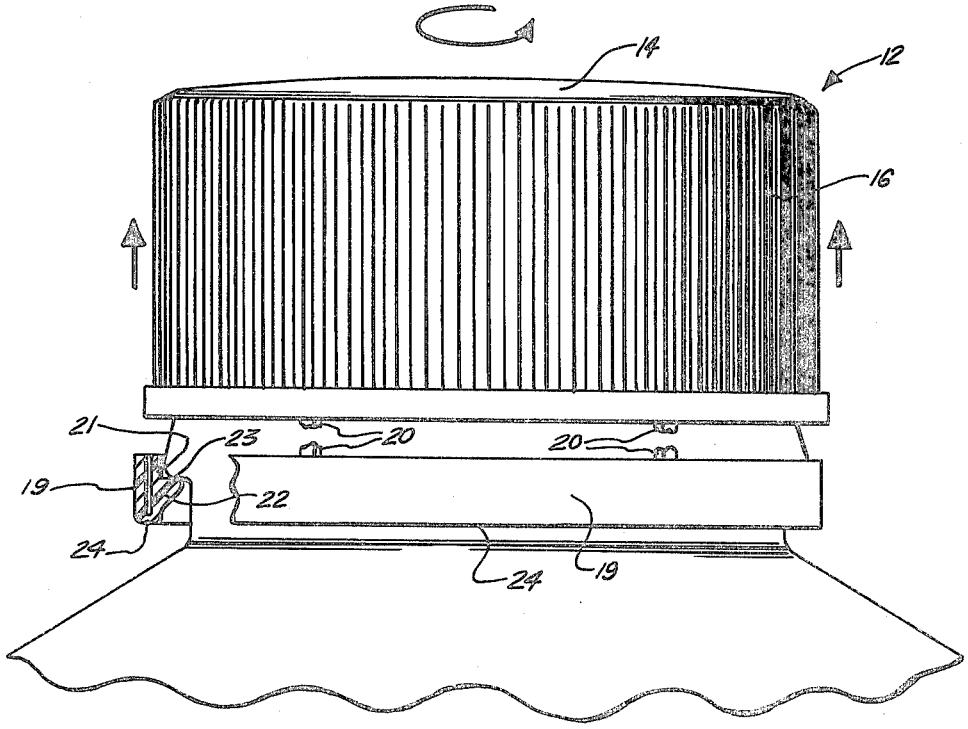
FIG. 4 is a partially broken away side elevational view of a closure of this invention as it is being removed from the container neck finish.

When an attempt is made to remove closure 12 from container neck finish 30, the torque necessary for removal causes closure 12 to be urged axially upward. This upward urging is resisted due to the before-described interference between base 23 and underside 33. However, by increasing removal torque on closure 12, the fracture point of frangible ribs 20 will be reached. At this point, frangible ribs 20 will break, thereby loosening from annular sidewall 16 its attachment with band 19. At this point, closure 12 is then free to be unthreaded from neck finish 30. Also, tampering is indicated by the fracture of frangible ribs 20. See FIG. 4.

By utilizing the tamperproof system of this invention, there is no danger that annular band 19 will fall from neck finish 30 after the closure is removed therefrom as the interference between base 23 and underside 33 is still maintained. Thus, the problem of having band 19 fall into the dispersed contents of the container is eliminated.

Another advantage of the tamperproof system of this invention is that tabs 21 are hidden from an attempt to defeat the interference relationship, above described, by the utilization of a probe tool such as a pen knife to pull tabs 21 downwardly so that base 23 is no longer located under annular flange 32. This advantage is achieved by having the ends of tabs 21 positioned between annular flange 32 and band 19. With this positioning, there is no way for engagement of the ends of tabs 21 by a tool to effect the attempted pull down maneuver.

The closures of this invention can be made of any suitable plastic material such as polypropylene, high density polyethylene, polyethylene terephthalate, nylon, etc. Further, the closures of this invention can be made by conventional injection molding techniques.

While the invention has been described in detail in connection with the depicted embodiments thereof, the description and illustrations are in no way intended to limit the scope of the invention.

What is claimed:

1. A thermoplastic closure for fitment to a container which has a threaded neck portion and an outwardly extending annular flange adjacent to but beneath said threaded neck portion, said thermoplastic closure comprising:

a. a top wall;

b. an annular sidewall downwardly extending from said top wall, said sidewall having about its inside surface a thread for cooperation with said neck thread;

c. an annular band attached to the lower portion of said annular sidewall and having an inside diameter larger than the diameter of said annular flange, said attachment being effected by way of a plurality of spaced-apart frangible ribs; and d. a plurality of spaced-apart tabs pendantly attached to the lower portion of said annular band, said tabs being inwardly foldable so that a tab portion will be in a position of interference with said container annular flange when said closure is fitted to said container, whereby, axial upward movement of said closure, upon unthreading rotation thereof, is resisted by said interference until said frangible ribs are broken.

2. The closure of claim 1 wherein said tab portion is at least one projection which extends outwardly from and is integral with the remainder of said tab and wherein said at least one outwardly extending projection provides an interference surface which is in a plane substantially perpendicular to the center axis of said closure when said tab is inwardly folded.

3. The closure of claim 2 wherein said interference surface, while in said plane, is positionable beneath the lower surface of said annular flange upon fitment of said closure to said container.

4. The closure of claim 3 wherein said projection is triangular in shape and wherein the lowermost side of said triangular projection extends radially outward and provides said interference surface.

5. The closure of claim 1 wherein there is a hinge line of reduced thickness at each point of attachment between said lower portion of said band and said tabs.

6. The closure of claim 5 wherein said tab portion is at least one projection which extends outwardly and is integral with the remainder of said tab and wherein said outwardly extending projection provides an interference surface which is in a plane substantially perpendicular to the center axis of said closure when said tab is inwardly folded.

7. The closure of claim 6 wherein said interference surface, while in said plane, is positionable beneath the lower surface of said annular flange upon fitment of said closure to said container.

8. The closure of claim 7 wherein said projection is triangular in shape and wherein the lowermost side of said triangular projection extends radially outward and provides said interference surface.

9. A tamperproof package comprising:

a container having, a threaded neck portion, and an outwardly extending annular flange adjacent to but beneath said threaded portion; and a thermoplastic closure comprising, a top wall;

an annular sidewall downwardly extending from said top wall, said sidewall having about its inside surface a thread for cooperation with said neck thread;

an annular band attached to the lower portion of said annular sidewall and having an inside diameter larger than the diameter of said annular flange, said attachment being effected by way of a plurality of spaced-apart frangible ribs; and a plurality of spaced-apart tabs hingedly and pendantly attached to the lower portion of said annular band, said tabs being folded inwardly about the hinged attachment so that a portion of each tab will be in a position of interference with respect to said container annular flange whereby axial upward movement of said closure, upon unthreading rotation thereof, is resisted by said interference until said frangible ribs are broken.

10. The closure of claim 9 wherein said tab portion is at least one projection which extends outwardly from and is integral with the remainder of said tab and wherein said outwardly extending projection provides an interference surface which is in a plane substantially perpendicular to the center axis of said closure.

11. The closure of claim 10 wherein said interference surface is positioned beneath the lower surface of said annular flange.

12. The closure of claim 11 wherein said projection is triangular in shape and wherein the lowermost side of said triangular projection extends radially outward and provides said interference surface.

13. The closure of claim 12 wherein there is a hinge line of reduced thickness at each point of attachment between said lower portion of said band and said tabs.

* * * * *